US005633983A

United States Patent [19]

Coker

[11] Patent Number: 5,633,983

[45] Date of Patent: May 27, 1997

[54] SYSTEMS AND METHODS FOR PERFORMING PHONEMIC SYNTHESIS

[75] Inventor: Cecil H. Coker, Chatham, N.J.

[73] Assignee: Lucent Technologies Inc., Murray Hill, N.J.

[21] Appl. No.: 304,959

[22] Filed: Sep. 13, 1994

[51] Int. Cl.[6] ..... G10L 5/02

[52] U.S. Cl. ..... 395/2.69; 395/2.7; 395/2.67; 395/2.75

[58] Field of Search ..... 395/2.69, 2.7, 395/2.67, 2.75; 381/51–53

[56] References Cited

U.S. PATENT DOCUMENTS

| | | | |
|---|---|---|---|
| 3,704,345 | 11/1972 | Coker | 395/2.69 |
| 4,703,505 | 10/1987 | Seiler et al. | 395/2.77 |
| 5,204,905 | 4/1993 | Mitone | 381/52 |
| 5,327,498 | 7/1994 | Hamon | 381/51 |

FOREIGN PATENT DOCUMENTS

| | | | |
|---|---|---|---|
| 0 363 233 | 4/1990 | European Pat. Off. | G10L 5/04 |
| 0 481 107 | 4/1992 | European Pat. Off. | G10L 5/04 |

OTHER PUBLICATIONS

Coker, C.H., "A Model of Articulatory Dynamics and Control," Proceedings of the IEEE, No. 4, vol. 64, Apr. 1976, pp. 452–460.

Flanagan, J.L., *Speech Analysis, Synthesis, and Perception*, 2nd ed., Springer–Verlag, 1972, pp. 43–48.

Olive, J.P. et al., "Speech Proceeding Systems That Listen, Too," AT&T Technology, vol. 6, No. 4, 1991, pp. 26–31.

*Primary Examiner*—Kee M. Tung

[57] ABSTRACT

Systems and methods for performing phonemic synthesis which operate to generate an output data set of acoustic B parameters from a received textual data set wherein the output data set represents patterns of transition from one speech excitation state to another. The textual data set is converted to a plurality of phonetic data sets, at least one phone descriptor is assigned to each of the phonemic data sets, and the output data set is generated by processing the phonetic data sets as a non-linear function of a speech excitation control variable whereby the collective contributions of the phonetic data sets are determined for each pattern of transition from one speech excitation state to another. The speech excitation control variable represents selected portions of a human vocal system.

20 Claims, 6 Drawing Sheets

0.1
0.09
0.08
0.07
0.06
0.05
0.04
0.03
0.02
0.01
0
STEP RESPONSE S(x)
γ = 3
γ = 2.6
d = .3,
γ = 2
d = .36,
γ = 2
-1
-0.9
-0.8
-0.7
-0.6
-0.7
NORMALIZED TIME x = t/TAU

AREA (mm²)
15
10
5
0
-5
A_g0
A_ga
A_gs
A_ps
-20
-15
-10
-5
0
5
10
A_gw(mm²)

FIG. 7
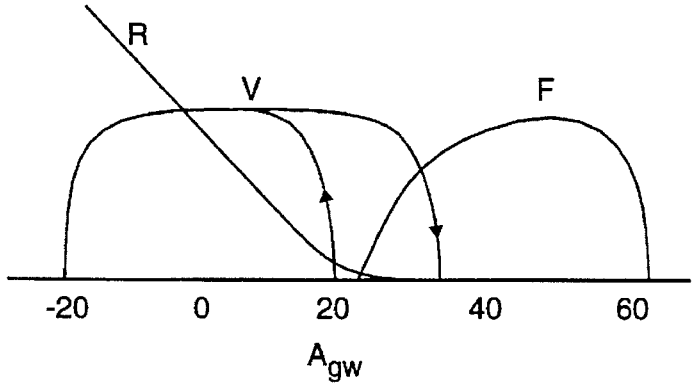
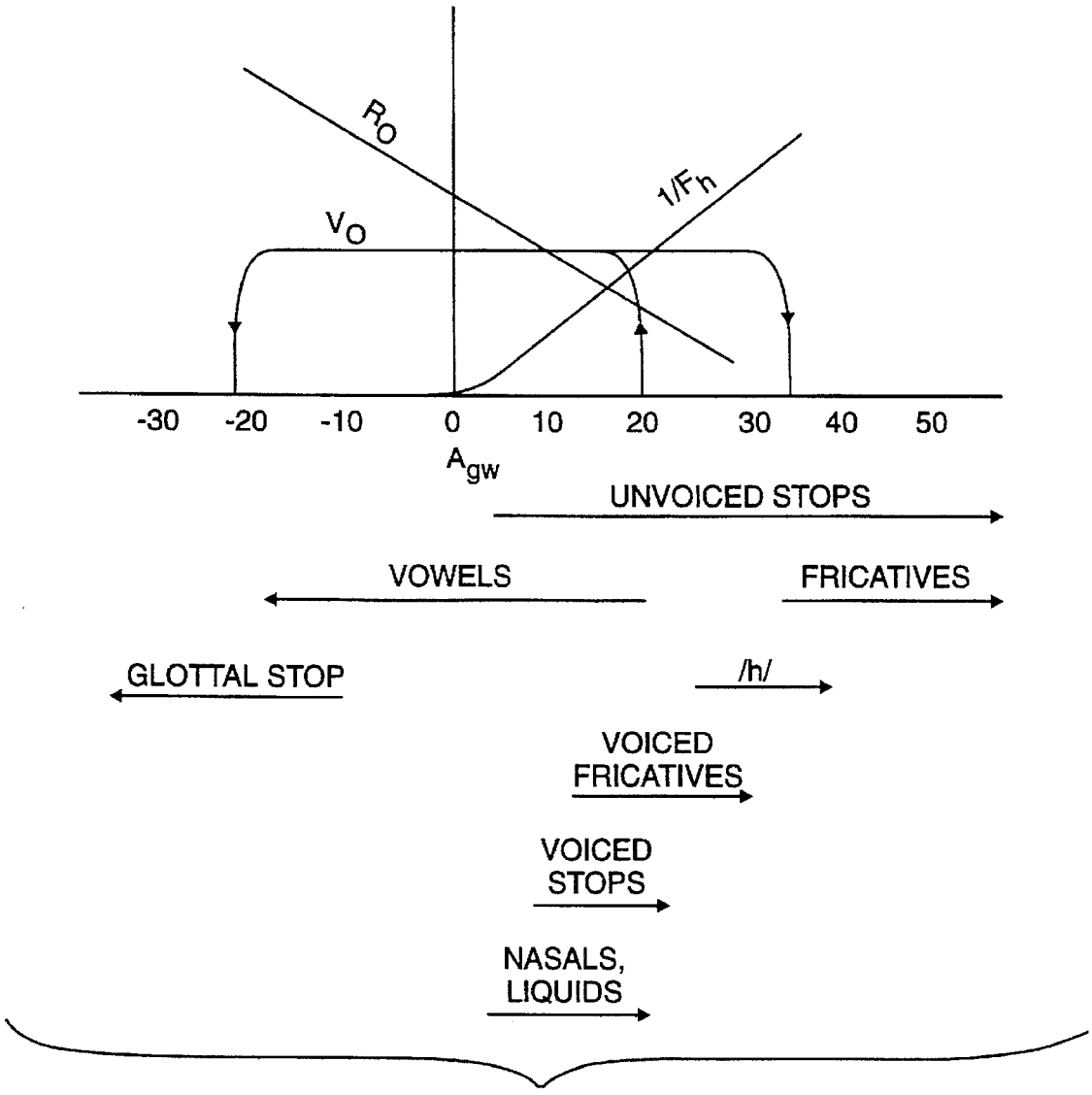
FIG. 8

SYSTEMS AND METHODS FOR PERFORMING PHONEMIC SYNTHESIS

TECHNICAL FIELD OF THE INVENTION

The present invention relates in general to acoustical analysis, and more particularly to systems and methods for performing phonemic synthesis.

BACKGROUND

Speech synthesis seeks to model actions of the human vocal tract to one degree of detail or another. Typically, conventional speech synthesis systems, for example, resonance, vocal-tract and LPC synthesizers, use sets of equations to compute a next sample sound from a given input, or source, and a short list of previous outputs. In resonance synthesizers, for example, there are sets of equations for each resonance below 4 kHz. In vocal-tract and LPC synthesizers, for example, sets of equations are used to describe various sounds at different places in the human vocal-tract.

Because human muscle tissue changes shape slowly by comparison to the durations of speech sounds, the human vocal tract operates to produce smooth transitions from one speech state to another. Accordingly, it is not enough for conventional synthesizers to string together sequences of steady invariant sounds. For one thing, abrupt jumps between sounds create distracting non-speech-like clicks and pops. For another, much of the identity of consonants, as well as some vowels, are conveyed, not by steady states, but by the manner of change from one state of speech sound to the next. Nuances in the character of various speech elements convey sentence structure, emphasis, and a host of less tangible communications, such as, for example, happiness, determination, skepticism, etc. Further, details with no direct communicative value may still be important, as any audible deviation from what listeners expect is a distraction, or worse, a misdirection. Sounding natural and pleasant therefore requires being correct as to great detail. Approaches to reproducing transitional details in speech synthesis typically follow one of two methods, transitions, either by rule, or by use of stored data.

The rules approach is used by many commercial synthesizers, and it describes transitions between speech elements as geometric curves plotted against time. The rules approach can describe the motions of vocal-tract resonances, or motions of the tongue, lips, jaw, etc. The stored-data approach, by comparison, typically records and analyzes natural speech, and excerpts from that examples of transitions between speech element pairs, or more generally, sequences beginning with ½ of one speech element and ending with ½ of another. Both approaches have several problems, including, being constrained to reproducing only first-order interactions between adjacent speech elements, as well as strict rules for reproducing each speech element failing to appreciate the variance in real language speech elements due to stress and situation relative to syllable and word boundaries. The rules approach typically settles for a simplistic representation of excitation, in part, because the transient behavior of excitation appears to be too complex to describe by a rule. In contrast, the stored-data approach reproduces these transitions, but only for cases stored to a processing system which are inherently limited by the quantity of marked and collected combinations of speech elements, stress and boundary examples, and context, not to mention the processing resources and storage devices available. The foregoing problems and constraints remain a dominant obstacle to producing accurate, and hence, commercially desirable, speech synthesizers.

SUMMARY OF THE INVENTION

In accordance with the principles of the present invention, systems and methods for performing phonemic synthesis are provided which reproduce the complex patterns of transition from one speech excitation state to another. Reproduction is accomplished by expressing a number of seemingly unrelated acoustic quantities, with complicated behaviors, as nonlinear dependencies on a single underlying parameter, or variable, with simple behavior. The underlying variable is driven by one command per phonetic element, in other words, a single phoneme or a half phoneme. A phoneme more particularly is a basic unit or element of speech sound. Response of the variable to those commands is generated as simple s-shaped transitions from one stated value to the next.

One processing system in accordance with the principles of the present invention for generating an output data set of data subsets for producing patterns of transition from one speech excitation state to another includes receiving means, at least one memory storage device, and at least one processing unit. The receiving means operates to receive a textual data set including at least one textual data subset. The memory storage device operates to store a plurality of processing system instructions. The processing unit operates to generate the output data set by retrieving and executing at least one of the processing unit instructions from the memory storage device. The processing unit transforms the received textual data set into a phonetic data set which includes a plurality of phonetic data subsets wherein each of the phonetic data subsets represents a particular speech state, and interpolates the phonetic data set as a function of a physiological variable representative of selected portions of a human vocal system to generate the output data set whereby the phonetic data subsets are summed to determine their collective contributions to each one of the output data subsets.

Another processing system in accordance with the principles of the present invention for performing phonemic synthesis includes an input port which operates to receive a textual data set comprising a plurality of textual data subsets, and at least one processing unit. The processing unit operates to generate an output data set representing a sequence of speech sounds by calculating a physiological variable as a function of selected physical changes of a human vocal system as the human vocal system transitions from one speech excitation state to another, and processing the textual data set as a function of the physiological variable to generate the output data set whereby the textual data subsets are converted to a plurality of phonetic data sets which are summed together to determine their collective contributions to each one of the speech sounds.

One method of operation in accordance with the principles of the present invention concerns the generation of an output data set of acoustic parameters from a received textual data set, wherein the output data set represents patterns of transition from one speech excitation state to another. The method converts the received textual data set to a phonetic data set which includes a plurality of phonetic data subsets wherein each of the phonetic data subsets represents a particular speech state. At least one phone descriptor is then assigned to each of the phonemic data subsets, which are converted to time series. A speech excitation control variable is produced which represents selected portions of a human vocal system. The output data set of acoustic parameters is generated by processing the phonetic data set as a non-linear function of the speech excitation variable whereby the collective contributions of the phonetic data subsets are determined for each pattern of transition from one speech excitation state to another.

One embodiment for using and/or distributing the present invention is as software stored to a storage medium. The software includes a plurality of computer instructions for controlling at least one processing unit for performing phonemic synthesis in accordance with the principles of the present invention. The storage mediums utilized may include, but are not limited to, magnetic, optical, and semiconductor chip. Alternate embodiments of the present invention may also be implemented in firmware or hardware, to name other examples.

BRIEF DESCRIPTION OF THE DRAWINGS

For a more complete understanding of the present invention, and the advantages thereof, reference is made to the following descriptions taken in conjunction with the accompanying drawings in which like numbers designate like parts, and in which:

FIG. 7 illustrates a graphical representation of a physiological variable, $A_{gw}$;

FIG. 8 illustrates a graphical representation of $A_{gw}$;

DETAILED DESCRIPTION OF THE INVENTION

The principles of the present invention, and the features and advantages thereof, are better understood by referring to the illustrated embodiment depicted in FIGS. 1–10 of the drawings.

Figure 1A:
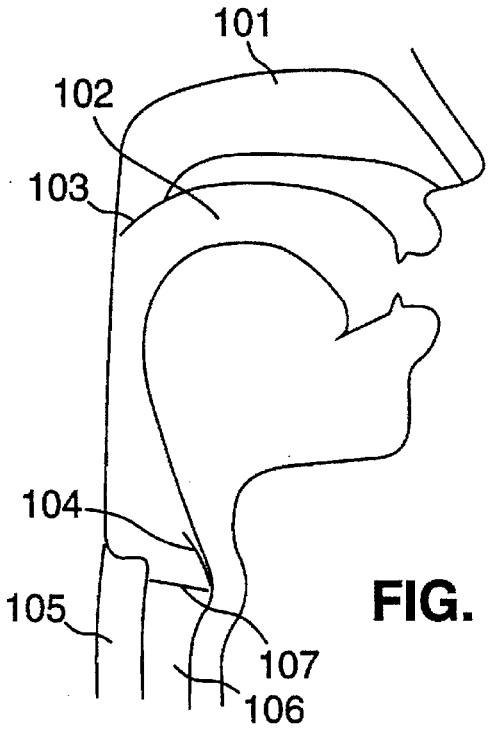
FIG. 1*a* illustrates a cross-sectional view of a human head.

FIG. 1*a* illustrates a cross-sectional view of a human head, including a nasal cavity 101, a vocal tract 102, a velum 103, an epiglottis 104, an esophagus 105, a trachea 106 and vocal cords 107. The vocal tract 102 operates to produce sounds when excited by some source, as for example, when the lungs force air against some resistance, causing the lungs to expend energy. A speech source, such as voiced excitation, aspiration and frication, is an aerodynamic process that converts lung power to audible sound. More particularly, voiced excitation is caused when air from the lungs is caused to flow through the trachea 106 vibrating the vocal cords 107; aspiration is caused when air from the lungs flows up through the trachea 106 to cause noise, such as aperiodic, non-repetitive or random sound, due to turbulence at or near the epiglottis 104; and frication is caused as air from the lungs flows up through the trachea 106 to cause noise due to turbulence at a constriction, such as, either the tongue against the palate or teeth (not shown), or the lips against the teeth (not shown), as examples. These sounds pass through the vocal tract 102 which acts as an acoustic resonator to enhance certain of their frequencies. An adult size vocal tract 102, for example, has three to six resonances in the speech band between 100 and 4000 Hz. Different vocal tract shapes vary widely and the different shapes are heard as a different phoneme. A phoneme, recall, is the basic unit of speech sound, which, when combined with other phonemes, form words. The various combinations of voiced excitation modes also serve to distinguish phonemes. For example, t, d, s, and z, have substantially the same vocal track shape, but differ in excitation.

Phonemic synthesis seeks to model the vocal tract shapes representing the target or goal of each phoneme. It is preferable however, that the transitions between phonemes be executed smoothly and naturally. Consider for example, the vocal tract characterization of four variables, v, r, a, and f. All may be modeled as dependent functions of physiological variable, $A_{gw}$, as shown in FIG. 7. $A_{gw}$ more particularly represents underlying muscle control of the vocal cords 107. Together with some knowledge of the place and degree of constriction in the vocal tract 102, if any. $A_{gw}$ operates to determine the amplitude and temporal behavior of aspiration and frication. $A_{gw}$ is utilized herein to synthesize speech in a manner which automatically traverses the natural Sequence of intermediate states. In accordance with principles of the present invention, the process illustrated with reference to FIG. 4 does not restrict phonemic synthesis to a single overlap of two phonemes as conventional processes do. This results from modeling $A_{gw}$ after the muscle commands and their related responses. It is the muscle tissue of the human vocal system however that causes phonemes to be blended together. An aspect of the present invention therefore is the utilization of an interpolation process which operates to sum up the contributions of all phonemes to generate speech sound. This results in a smooth and natural transition between phonemes and their intermediate states.

Figure 1B:
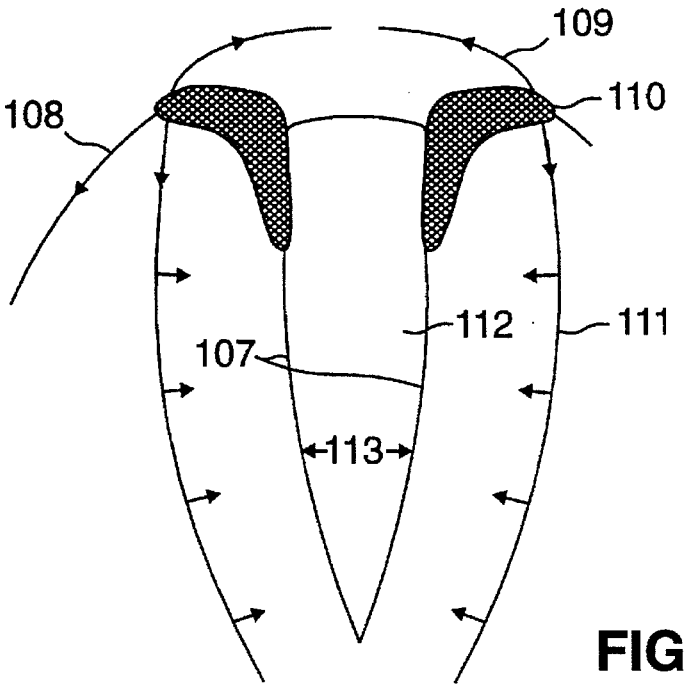
FIG. 1*b* illustrates a cross-sectional view of the human glottis.

FIG. 1*b* illustrates a cross-sectional view of a human vocal system including the vocal cords 107, lateral cricoarytenoid muscles 108, posterior cricoarytenoid muscles 109, arytenoid cartilages 110, exterior thyroarytenoid muscles 111, and a glottis 112. The glottis 112 is the area between the vocal cords 107. During breathing, the vocal cords 107 are pulled wide apart by the posterior cricoarytenoid muscles 109, which rotate the arytenoid cartilages 110. During speech, the vocal cords 107 open similarly, but by a relatively lesser amount, for fricative sounds. During voiced sounds, the vocal cords 107 are closed, mainly by the exterior thyroarytenoid muscles 111, which in turn rotate the arytenoid cartilages 110. The glottal area is further influenced by two other physical factors, pressure 113, $P_s$, from the lungs, which pushes outward at the center of the vocal cords 107, and a curvature of the exterior thyroarytenoid muscles 111, which press inward at the center of the vocal cords 107.

Figure 2:
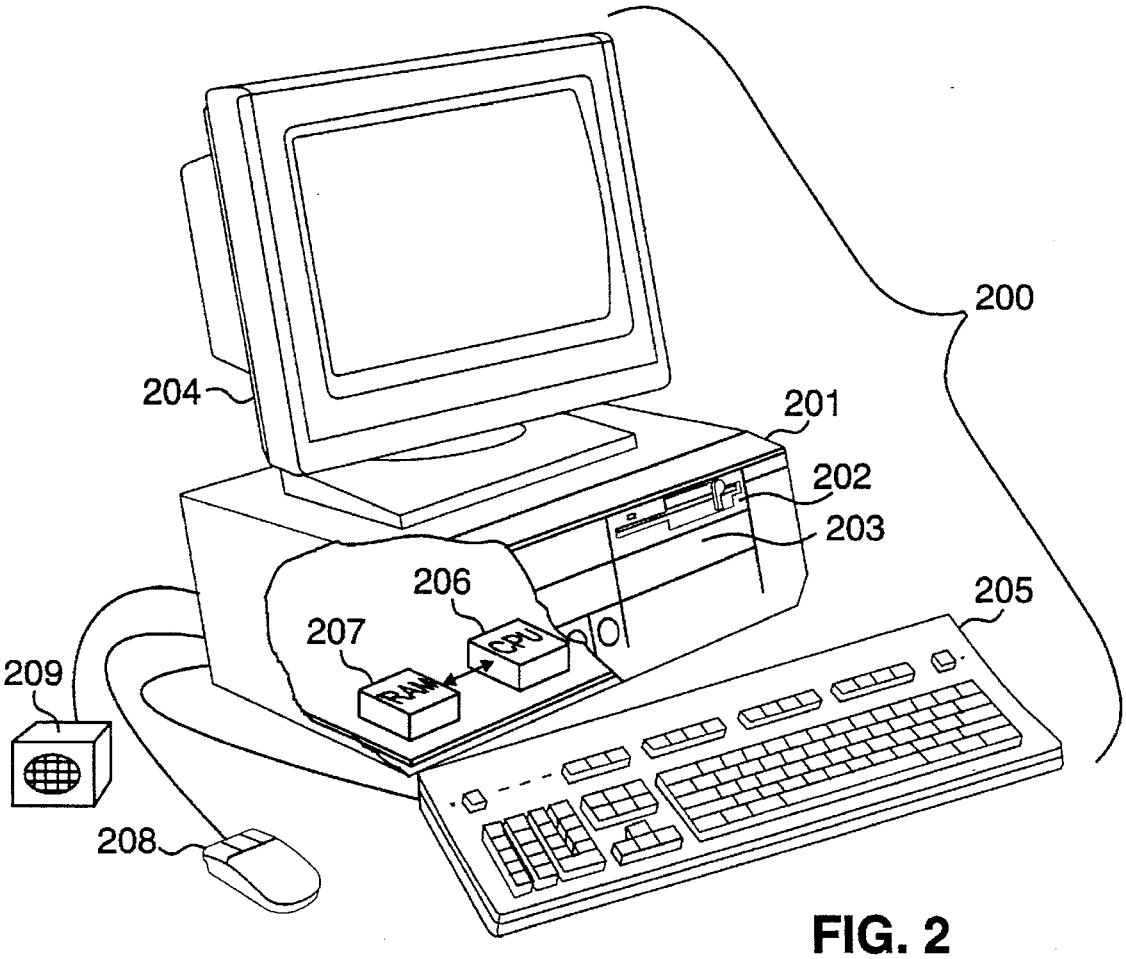
FIG. 2 illustrates an isometric view of a personal computer in accordance with the principles of the present invention.

FIG. 2 illustrates an isometric view of a personal computer ("PC") 200 coupled with a conventional device for generating acoustical energy 209. PC 200 may be programmed to perform phonemic synthesis in accordance with the principles of the present invention. PC 200 is comprised of a hardware casing 201 (illustrated as having a cut-away view), a monitor 204, a keyboard 205 and a mouse 208. Note that the monitor 204, and the keyboard 205 and mouse 208 may be replaced by, or combined with, other suitably arranged output and input devices, respectively. Hardware casing 201 includes both a floppy disk drive 202 and a hard disk drive 203. Floppy disk drive 202 is operable to receive, read and write to external disks, while hard disk drive 203 is operable to provide fast access data storage and retrieval. Although only floppy disk drive 202 is illustrated, PC 200 may be equipped with any suitably arranged structure for receiving and transmitting data, including, for example, tape and compact disc drives, and serial and parallel data ports. Within the cut away portion of hardware casing 201 is a processing unit 206, coupled with a memory storage device, which in the illustrated embodiment is a random access memory ("RAM") 207. Although PC 200 is shown having a single processing unit 206, PC 200 may be equipped with a plurality of processing units 206 operable to cooperatively carry out the principles of the present invention. Similarly, although PC 200 is shown having the single hard disk drive 203 and memory storage device 207, PC 200 may be equipped with any suitably arranged memory storage device, or plurality thereof. Further, although PC 200 is utilized to illustrate a single embodiment of a processing system, the principles of the present invention may be implemented within any processing system having at least one processing unit, including, for example, sophisticated calculators and hand held, mini, main frame and super computers, including RISC and parallel processing architectures, as well as within processing system network combinations of the foregoing. In the preferred embodiment, PC 200 is an IRIS INDIGO workstation, which is available from Silicon Graphics, Inc., located in Mountain View, Calif., USA. The processing environment of the workstation is preferably provided by a UNIX operating system.

Figure 3:
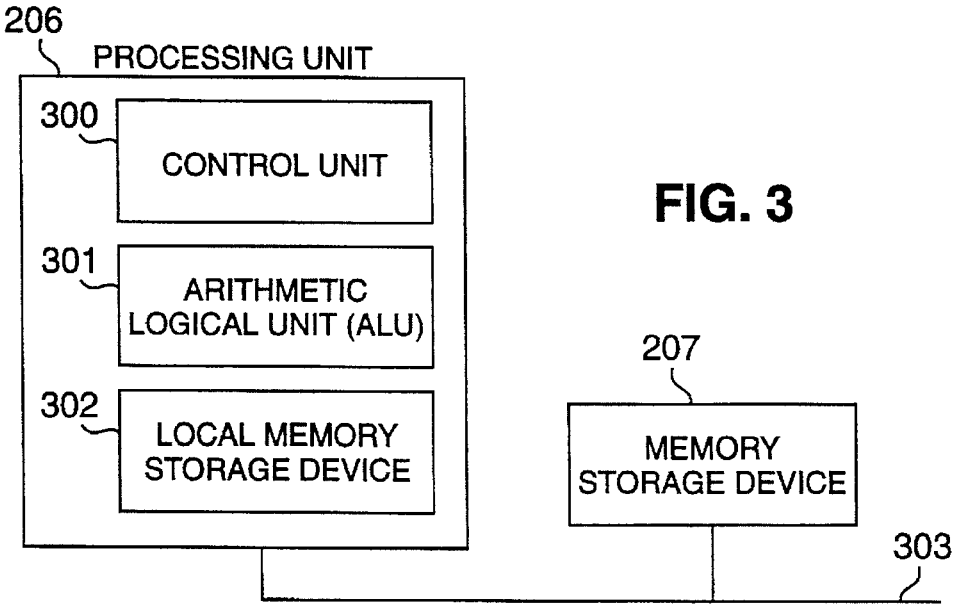
FIG. 3 illustrates a block diagram of a microprocessing system, including a single processing unit and a single memory storage device, which may be utilized in conjunction with the personal computer in FIG. 2.

FIG. 3 illustrates a block diagram of one microprocessing system, including a processing unit and a memory storage device, which may be utilized in conjunction with PC 200. The microprocessing system includes a single processing unit 206 coupled via data bus 303 with a memory storage device, such as RAM 207, for example. Memory storage device 207 is operable to store one or more instructions which processing unit 206 is operable to retrieve, interpret and execute. Processing unit 206 includes a control unit 300, an arithmetic logic unit ("ALU") 301, and a local memory storage device 302, such as, for example, stackable cache or a plurality of registers. Control unit 300 is operable to fetch instructions from memory storage device 207. ALU 301 is operable to perform a plurality of operations, including addition and Boolean AND needed to carry out instructions. Local memory storage device 302 is operable to provide local high speed storage used for storing temporary results and control information.

Figure 4:
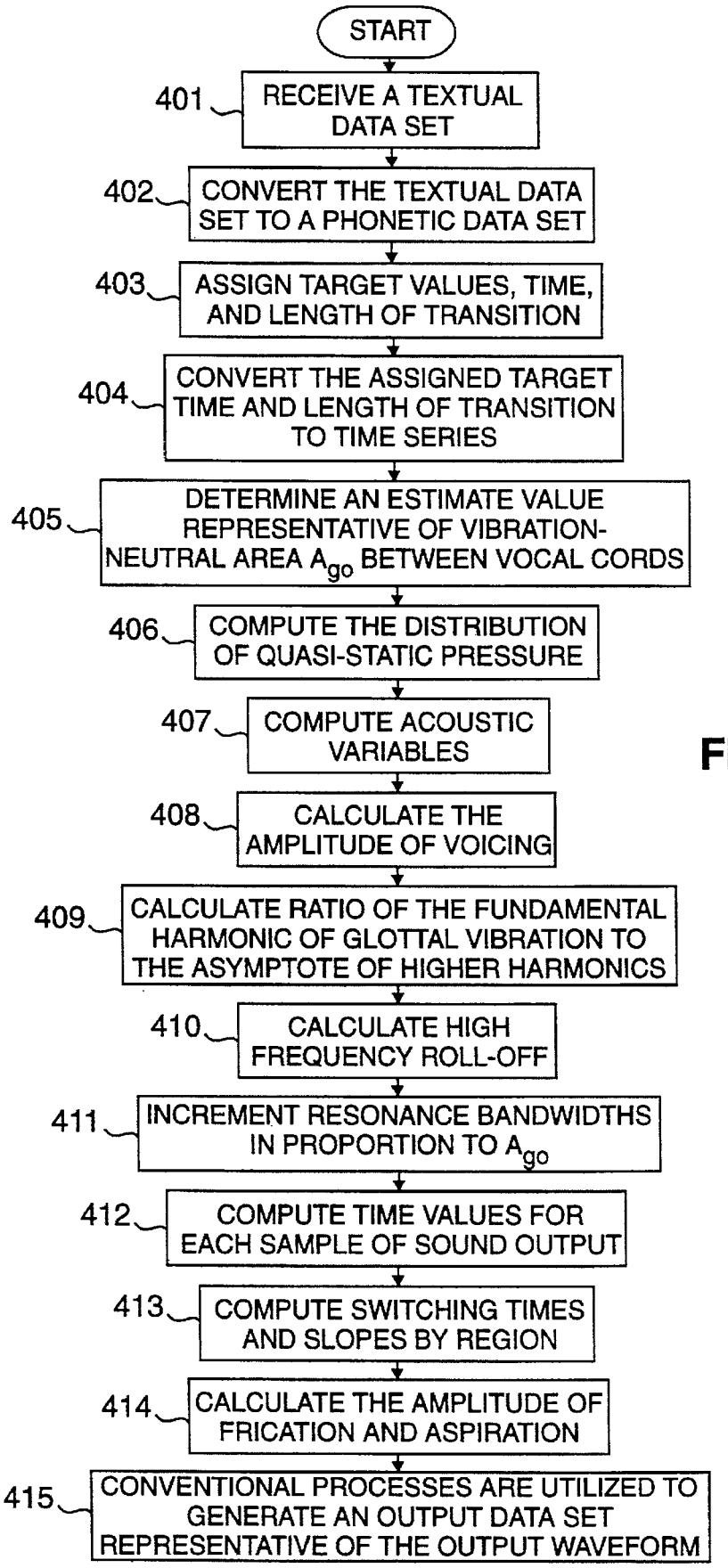
FIG. 4 illustrates a flow diagram of a process for performing phonetic synthesis in accordance with the principles of the present invention.

FIG. 4 illustrates a flow diagram of a process for performing phonemic synthesis in accordance with the principles of the present invention. The process herein illustrated is programmed in the FORTRAN programming language, although any functionally suitable programming language may be substituted for or utilized in conjunction therewith. The process is preferably compiled into object code and loaded onto a processing system, such as PC 200, for utilization. Alternatively, as previously mentioned, the principles of the present invention may be embodied within any suitable arrangement of firmware or hardware.

The illustrated process begins upon entering the START block, whereupon a textual data set, which includes one or more textual data subsets, is received, block 401. Each textual data subset may include any word, phrase, abbreviation, acronym, connotation, number or any other cognizable character, symbol or string. The textual data set signifies words, numbers and perhaps phonemes. The textual data set is converted to a phonetic data set, block 402. The phonetic data set includes phones, together with stress marks, pause marks, and other punctuation to direct the "reading" of the utterance. A phone more particularly is any phoneme or phoneme-like item within a stored database of the phonemic synthesizer. The database preferably is a collection of phonemic data stored to a processing system, such as PC 200, for example. The techniques for performing this conversion are known, and are more fully described in, for example, "Speech Processing Systems That Listen, Too", *AT&T Technology*, vol. 6, no. 4, 1991, by Olive, Roe and Tischirgi which is incorporated herein by reference. Preferably, each of the textual data subsets representative of a phrase, abbreviation, acronym, number, or other cognizable character, symbol or string is mapped to and replaced by an ordinary word. The textual data set is also preferably submitted to a pronunciation and dictionary process which converts each of the textual data subsets, individually or in related groups, to corresponding subsets of a phonetic data set. Preferably, the pronunciation and dictionary process also performs phrase analysis to insert punctuation to control emphasis/de-emphasis and pauses. The foregoing is also discussed in "Speech Processing Systems That Listen, Too", *AT&T Technology*, vol. 6, no. 4, 1991, by Olive, Roe and Tischirgi, which has previously been incorporated by reference.

In the illustrated embodiment, the phonetic data set is preferably comprised of three data structures, namely, three one dimensional lists, PEON[I], STRESS[I] and DUR[I], the phone, stress and assigned duration, respectively, for each segment, I. Each segment is preferably a single phone. For example, consider the textual word "market", which is comprised of six letters. Note that there is often not a one-to-one correspondence between letters and phones. When "market" is converted to a phonetic data format, it becomes six phones, "m", "a", "r", "k", "i" and "t", in other words, each is a separate segment. These segments are stored as PHON[1]="m" to PHON[6]="t". Preferably, there is a STRESS[I] and DUR[I] associated with each segment. STRESS[I] and DUR[I] are preferably assigned values retrieved from a database wherein PHON[I] is utilized to index appropriate values. Further, for each segment there is an associated parameter, J, representative of a slowly changing time scale for the segment. Each parameter preferably includes $A_{gw}$ and $P_s$, as well as any other variables appropriate to a desired speech synthesis system having certain preferred functionality. For each segment and each parameter there are preferably assigned three values, VAL[I,J], TAU[I,J], and T[I,J], block 403. VAL[I,J] is an assigned target value of parameter J for segment I. TAU[I,J] is the length of transition of parameter J from segment I-1 to segment I, in other words, the time for an s-shaped transition to preferably go from 10% to 90% complete. T[I,J] is the time, measured from a convenient reference point, for the s-shaped transition to be 50% complete, or in other words, the time period for the transition for parameter J to move from the value for segment I-1 to that for segment I, preferably in milliseconds. The assignment of VAL[I,J], TAU[I,J] and T[I,J] is from a database of phone descriptors, and is more clearly illustrated in Table 1. In the illustrated embodiment, the descriptor database includes the files VALP [PH,J], DELTAV[PH,J], PRI[PH,J] and TAUV[J]. Preferably, PH is a temporary variable for indexing into the database; VALP[PH, J] includes a target value for parameter J and segment PH; DELTA[PH,J] includes a point-slope value to account for the variation with stress; PRI[PH,J] includes a value between 0 and 0.5 indicating the relative importance of parameter J to segment PH; and TAUV[J] includes the characteristic speed of parameter J.

TABLE 1

```
IPH = PHON[0]          /*  previous phone */
for I = 1,nseg         /*  step through phonetic data set,
                           first phone to last */
{ PH = PHON[I]         /*  PH set equal to current
                           phone */
 for J = to nvar       /*  step through variables
                           associates with phone
                           */
 { VAL[I,J] = VALP[PH,J] + STRESS[I]*DELTA[PH,J]
                       /*  set target value */
  TAU[I,J] = TAUV[J]/* set length of
 transition */
  if (j==1 && [is_one_of(pj,v,z,σ3,h)  ||
 is_one_of(pj,v,z,σ3,h) TAUV[J]* = 2
  T[I,] = TAUV[J] *[PRL[LPH,J]-PRI[PH,J]]
 }
1ph – ph
}
```

Note that the above illustrated algorithm includes an "if" clause which operates to determine if its first argument matches any other argument, such as, for example, where "D" is the "TH" in "weaTHer" or "Z" is in "aZure". This "if" clause was incorporated for illustrative purposes only, and it should be noted that any functionally suitable code may be included to perform a desired operation. Also, the counters, NSEG and NVAR, are preferably previously defined, and operate to store the total number of segments and variables, respectively. The foregoing assignment of target values, time, length of transition, subglottal pressure, etc. are more fully described in "A Model of Articulatory Dynamics and Control", *Proceedings of the IEEE,* vol. 64, no. 4, pp. 452–460 (1976), by C. H. Cocker, which is incorporated herein by reference.

The quantities VAL[I,J], TAU[I,J] and T[I,J] are converted from one phone per segment to time series $V_j(t)$, wherein s-shaped transitions are evaluated at steps in time, either one per pitch period, or other sampling interval, block 404. Note that parameter J continues to preferably refer to variables $A_{gw}$ and $P_s$, as well as possibly other desired values as appropriate to the particular synthesis system. If equal time intervals are utilized, the interval is preferably on the order of 10 msec. The preferred time conversion is expressed by, $$V_J(t) = VAL_{I,J} + \sum_I S\left(\frac{t - T_{I,J}}{TAU_{I,J}}\right)(VAL_{I,J} - VAL_{I-1,J})$$

wherein $V_j(t)$ is the step response of either glottal width or subglottal pressure; VAL[I,J] is the target value of the segment and parameter; S(x) is the phone I step response of a filter; and the quantity VAL(I,J)–VAL(I-1,J) is the change in target value between segments I-1 and I. The summation over i is representative of the sum of the number of step responses. The summation method is possible because the working variable closely models the inertial and viscous properties of the glottal muscles and their control. The preferred time conversion is more clearly illustrated in the form of pseudocode in Table 2.

TABLE 2

```
VO = 0                 /*  Initial amplitude of voicing */
t = 10                 /*  Time of previous pitch
                           period */
tinc = 0 while ((tt=tinc)>total_t)
{(for j=1 to nvar      /*  step through all variables
{(vJ=VAL[J]            /*  target value of parameter J at
                           time 0 */
for I=2 to nseg        /*  accumulate influence of each
                           segment */
vJ = VJ+S(t–(t + T[I,J])/TAU[I,J])
v[J]=vJ                /*  value of the Jth variable
                           at the current time
}
```

Figure 5:
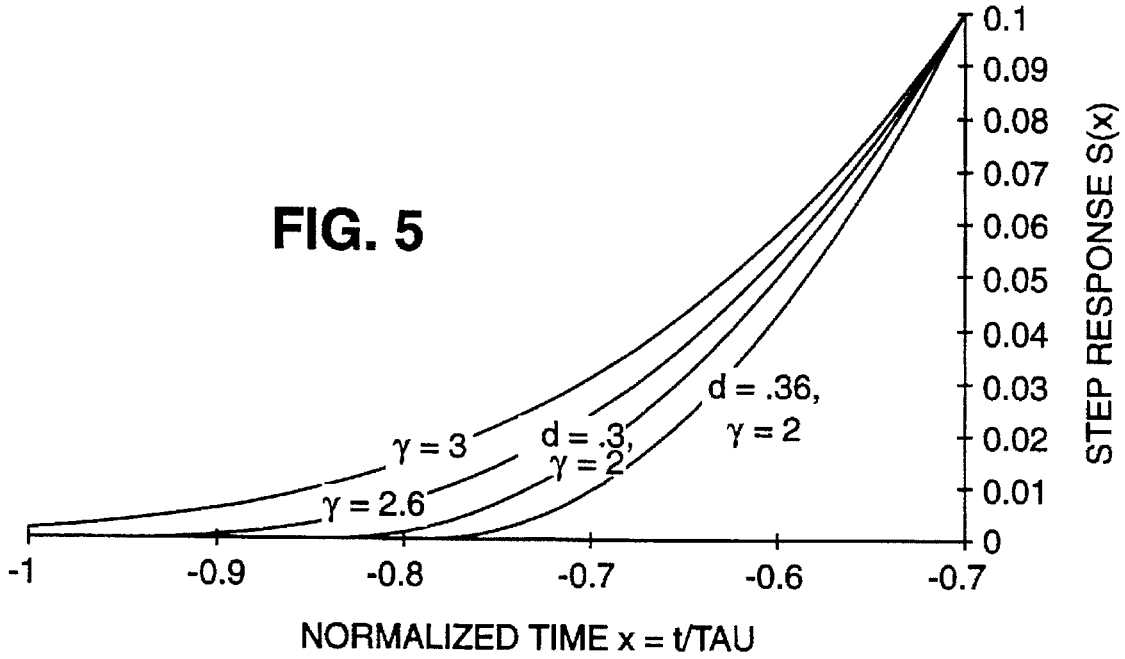
FIG. 5 illustrates a graphical representation of a preferred response of a filter, S(x)

In the illustrated embodiments, preferably, v[1] is $A_{gw}$ and v[2] is $P_s$. One preferred form of values of the function S(x) is given by, $$\begin{aligned}
S(x) &= 0 && u = gx \leqq -a \\
&= b(a+u)^{\gamma} && -a < u < -d \\
&= u + \frac{1}{2} && -d \leqq u \leqq d \\
&= 1 - b(a-u)^{\gamma} && d < u < a \\
&= 1 && a \leqq u
\end{aligned}$$

$$a = \gamma(.5 - d) + d$$

$$b = \frac{1}{\gamma(a-d)^{\gamma-1}}$$

$$\begin{aligned}
g &= 0.8 && d \geqq 0.4 \\
&= 2\left(a - \sqrt[\gamma]{\frac{.1}{b}}\right) && \text{otherwise}
\end{aligned}$$

wherein d represents the length of a straight portion ($0 \leqq d < 0.5$); $\gamma$ is the length of the "tail" of the curve of departure from an approach to particular target values; and a, b, g and u are dependent quantities utilized to simplify the equation. To produce realistic results, values of d are preferably in the order of 0.3 $\gamma$ of about 2.5. A typical preferred response is illustrated in FIG. 5. While the above processing steps and equations are preferred, it should be noted that any suitably arranged filter for preferably providing an s-shaped response similar to that illustrated in FIG. 5 may be utilized with, or substituted for, the above processing steps and equations.

As previously introduced, $A_{gw}$ represents glottal muscle behavior expressed in units of area. $A_{gw}$ represents relaxation of the exterior thyroarytenoid 111 and tension of the posterior cricoarytenoid 109 muscles as illustrated in FIG. 1*b*. $A_{go}$ represents the vibration-neutral area between the vocal cords, also known as the glottal opening. $A_{gw}$ is scaled such that a curve of the actual physical glottal area, as represented by $A_{go}$ versus $A_{gw}$, and has a slope of approximately one for $A_{go}$ larger than approximately 5 $mm^2$. Tensing the cricoarytenoid muscles 109, which reduces the value of $A_{gw}$, rotates the arytenoids 110, causing the vocal processes to be brought together. This contribution is referred to as $A_{ga}$. Subglottal pressure $P_s$, pushes outward in the center of the vocal cords 107 causing a deflection, this contribution is referred to as $A_{ps}$. Curvature of the exterior thyroarytenoids 111 exerts an inward pressure from the sides, causing a deflection. This contribution is referred to as $A_{gs}$. $A_{go}$ is the resulting summation of these three effects, block 405, as given by, $$A_{go}=A_{ga}+A_{ps}+A_{gs},$$

wherein the preferred values of $A_{ga}$, $A_{ps}$ and $A_{gs}$ are given by $$A_{ps} = 5/7P_S,$$

$$A_{gs} = -.13\ A_{gw}, \text{ and}$$

$$A_{ga} = .48A_{gw} + .52\sqrt{(A_{gw} + 2.3)^2 + 4A_{knee}^2} + .16;$$

$$A_{knee} = 1.25.$$

$P_s$, as previously introduced, represents the air pressure from the lungs which pushes outward at the center of the vocal cords 107 in FIG. 1*b*, and $A_{knee}$ is representative of the abruptness of transition from a relatively flat slope to a comparatively steeper slope and the transition corresponding physically to the hardness of the tips of the arytenoids (the vocal processes). Preferably, the value of $A_{knee}$ is approximately 1.25. The preferred process steps for calculating the vibration-neutral area between the vocal cords is more clearly illustrated in the form of pseudocode, in Table 3.

TABLE 3

| | | |
|---|---|---|
| $A_{ps}$ = 5/7*v[2] | /* | pressure component of glottal area; v[2] = $A_{gw}$ */ |
| $A_{gs}$ = .13*v[1] | /* | pressure component of side area; v[1] = $A_{gw}$ */ |
| Ap = .48+.52*sqrt((v[1]+2.3)**2+5)+.16 | /* | arytenoid component */ |

Figure 6:
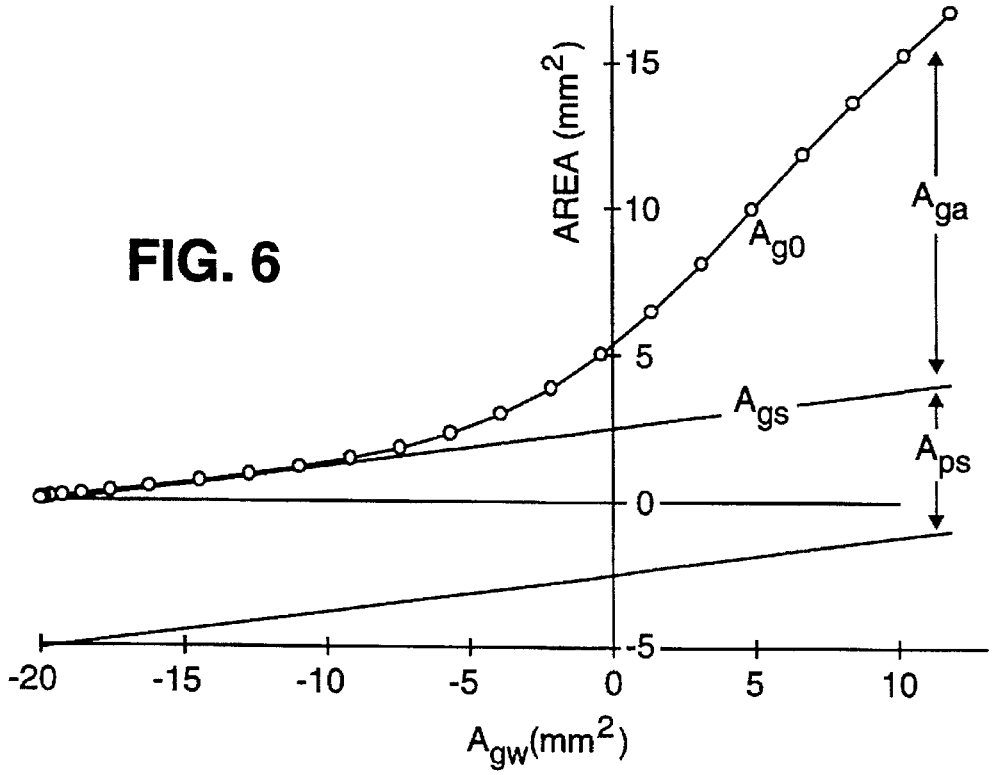
FIG. 6 illustrates a graphical representation of the approximate behavior of a vibration-neutral area between the vocal cords.

Turning to FIG. 6, there is illustrated a coordinate diagram graphically representing the behavior of $A_{go}$, wherein the plotted points on the curve are at approximately 4 msec intervals. Note that there are two essential linear regions, a first region wherein the arytenoid cartilages 110 are free to rotate, and a second region wherein the arytenoid cartilages 110 are blocked from further motion. As $A_{gw}$ becomes more negative, moving from a positive value, the vocal processes of the arytenoid cartilages 110 come into contact and press together, preventing further motion. The arytenoid component of area $A_{go}$ saturates at 0, and further change in $A_{go}$ results from the side pressure component $A_{gs}$. Thus, $A_{go}$ has two straight line regions, a low area and a high area region. In the low area region, the arytenoid cartilages 110 are pressed together and are unable to move further. In that region, area is the sum of the air pressure component $A_{ps}$ and the side pressure component $A_{gs}$. By comparison, in the high area region, the arytenoid cartilages 110 move freely. The difference between $A_{go}$ and the extension of the low area region is the arytenoid component $A_{ga}$. The illustrated process then computes the distribution of quasi-static pressure in the vocal tract 102 across the vocal cords and any constriction, such as teeth, lips, etc., block 406. Note that flow through a constriction follows Bernoulli constriction theory, which is more fully described in *Speech Analysis, Synthesis, and Perception,* 2nd ed., pp. 43–48, Springer 1972, by J. L. Flanagan, which is incorporated herein by reference. Further, note, in accordance with the elementary law of physics, $$F=mA,$$

which predicts an elemental volume of air, when accelerated across a pressure differential, P, to obtain a velocity, v, given by the rule, $$P=\frac{1}{2}\ \rho v^2, \text{ or } v=\sqrt{\frac{2P}{\rho}}$$

wherein P is the air pressure across the constriction; and ρ is the density of the air. The total volume of air flow, U, is defined by the product of the area, a, and the velocity, v, $$U=\sqrt{\frac{2P}{\rho}}$$

wherein a is the area of the orifice, preferably either the glottal area or the constriction area. Note, for the steady state case, flow out of the vocal cavity must be equal to the flow in, wherein equating flow in and flow out is given by, $$\overline{U_g}=\overline{U_c};\ \overline{a_g}\sqrt{\overline{P_g}}=a_c\sqrt{\overline{P_c}}$$

and subscripts, G and C, denote glottis and constriction, respectively, and the bars denote an average over some time period, in other words, one or more pitch periods. Subglottal pressure, $P_s$, is equal to the pressure across the constriction plus the pressure across the lips is given by, $$P_s=\overline{P_g}+\overline{P_c}$$

and $$\overline{P_c}=\frac{\overline{a_g}^2}{\overline{a_g}^2+a_c^2}\ P_s;\ \overline{P_g}=P_s-\overline{P_c}$$

Note, however, the vocal cavity has yielding walls and air is compressible. The resulting spring-like quality causes, for a relatively momentary period, a difference from the air flow into the vocal cavity to the air flow out. If the flow resistances were linear, Pc would approach an air target at an exponential time curve, however because of the non-linearity of air pressure flow relationships, the approach is approximately exponential, and therefore, an exponential curve is a preferable approximation. The computation of instantaneous oral-cavity pressure $P_c$ is given by, $$P_c\approx\overline{P_c}+a(P_c-\overline{P_c}).\quad \text{where}\quad a=\exp\left(\frac{-d}{\tau}\right)$$

TAU is given by, $$\tau=k\frac{A_g}{A_g^2+A_c^2}$$

The computation of the distribution of glottal air pressure is more clearly illustrated in the form of pseudocode, in Table 4. Note the following code is operable within the parameter J step loop of Table 3, which was not closed,

TABLE 4

```
Ag = Ago+.3*max(O,V-Ago)                    /*  compute the effective
                                                area
    **  for computing air flow; the presumes knowledge
    **  of the constriction area plus nasal area; if
    **  the phonemic synthesizer does not operate to
    **  compute one or both of these areas, then Acn
    **  would be estimated as one of the v[J] */
Pc13 = Ag__**2/(Ag13 **2++Acn**)            /* the eventual of cavity
    **  pressure if areas do not change */
TAUP = KTAUP*Ag__/(Ag__**+Acn**2)           /*  time constant of cavity
    **  pressure */
a = exp(-(t-1t)/TAUP)                       /*  coefficient for a
    **  digital filter */
Pc = Pc__+a*(Pc-Pc__)                       /*  instantaneous cavity
    **  pressure */
Pg = Ps-Pc                                  /*  trans-glottal pressure */
```

$A_{g__}$ is the estimated average glottal area, which, for large $A_{go}$ this will be the same as $A_{go}$. However, if $A_{go}$ is less than v, then vibration will be asymmetric, in other words, the positive swing will be larger than the negative swing. The pressure computation presumes that area of the velum and any vocal-tract constriction are known, if the phonemic synthesizer is not articulatory, then a workable sum of velar and constriction area $A_{cn}$ can be computed as an extra variable in block 404. $A_{cn}$ is preferably 15 $mm^2$ for voiced and unvoiced fricatives, zero for stops, and much larger than glottal area for all other sounds.

$A_{gw}$, $A_{go}$, $P_g$ and $P_c$ are preferably utilized to compute a number of dependent variables, block 407. The amplitude of voicing is calculated, block 408, by first calculating a threshold of voicing, $$A_t = k_t\sqrt{\max(P_g - P_{gt}, 0)}$$

Note, that the amplitude of voicing does not change instantaneously. The threshold of voicing is utilized to determine a target value to which a voicing amplitude will converge exponentially, $$\overline{V_{target}} = \min\left(1, \frac{\max(O, A_t - A_{g0} + k_{VH}V)}{4}\right) \cdot \min\left(1, \frac{\max(0, A_{g0} + k_{VL}V)}{4}\right) \cdot V_{typ}$$

wherein $V_{typ}$ is a typical amplitude of vocal cord vibration, and is preferably approximately 15 $mm^2$. TAU is the time constant of growth and decay of vibration amplitude. Amplitude typically tends to rise faster than it decays.

$$TAU = V_{t__} > VO\ ?\ 20:40$$

A filter coefficient, b, is preferably calculated, $$b = \exp((1t - t)/tau),$$

which is utilized to determine the amplitude of voicing which is given by, $$VO = V_t + b(VO - V_t).$$

Figure 9:
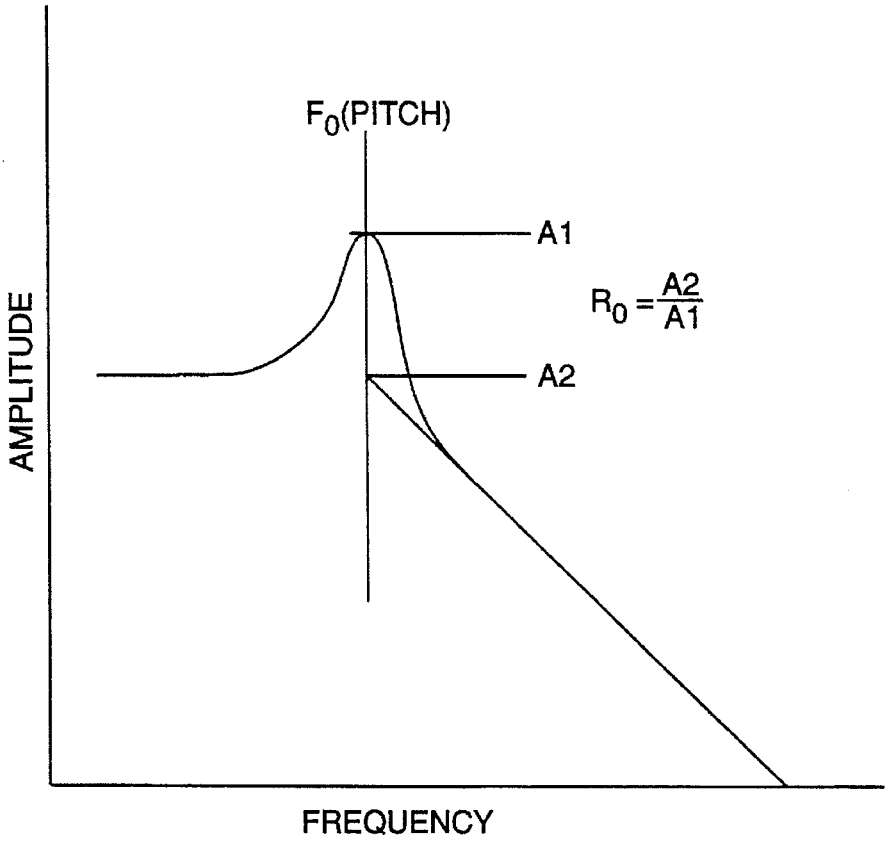
FIG. 9 illustrates a graphical representation of amplitude versus frequency of harmonics.

The glottal spectrum normally rolls off at −12 dB/octave from about the third harmonic out to several kHz. An acoustic quantity, RO, specifies the ratio of the fundamental harmonic of glottal vibration to the asymptote of higher harmonics, which is given by, $$RO = 4/26*(4.5 - Agw),$$

block 409. The values 4, 26 and 4.5 are preferable approximations. RO is the amplitude of higher-frequency voiced sound divided by the amplitude of the fundamental harmonic, VO, as is illustrated in FIG. 9.

Note, as glottal area increases, however, the shape of the curve also changes. Referring back to FIG. 1*b*, when the vocal processes are in full contact, the vocal cords 107 are nearly perfectly parallel, and vibratory closure occurs almost simultaneously across the length of the glottis 112. However, if arytenoid cartilages 110 are partially open, closure occurs first at the anterior end of the glottis 112, and proceeds, like a zipper, toward the posterior end of the glottis 112 and the arytenoid cartilages 110. This gradual closure is almost exactly exponential in time, thus defining a time constant kh as proportional to the arytenoid component of area $A_{ga}$ plus a constant $A_{ga}X$ (about 2.5 $mm^2$), and inversely proportional to pitch frequency FO and to the amplitude of voicing VO. Above a frequency $F_h$, the spectrum begins to roll off at −18 dB/octave, block 410, given by, $$F_h = kh*FO*VO/(A_{ga} + A_{gax}).$$

Preferably kh is approximately 3, $A_{gax}$ is a constant setting the highest attained value of $F_h$, for stressed vowels. For most male speakers, a value of $A_{gax}$ of 2.5 $mm^2$ is preferable. FO is the voice pitch frequency.

Note further, that when the glottis 112 is open, the acoustic resonator formed by the vocal tract 102 is exposed to the lungs which operate as a sound absorber. The power loss resultant from the sound absorption broadens the bandwidths of resonances. A preferred approximation of this effect is defined by incrementing the resonance bandwidths in proportion to $A_{go}$, block 411, which is given by the following pseudocode, in Table 5.

TABLE 5

```
for x = 1 to 4
  {B[x] - B[x] + K[x] - Ago
}
```

Preferably, values K[1]=0.6 and K[2 . . . 4]=1 match the performance of most human speakers. The preceding computations are preferably accomplished once every pitch period. The time values of aspiration and frication are preferably computed for each sample of the sound output, block 412. The preferable sampling rates for speech are between 8 and 12 samples per msec. The time values are preferably given by,

*nts=t*samp rate,*

*pp=nts−tsamp,* wherein nts is the number of time samples counting from time 0 to the current time, t; t-samp is a counter that totals the number of time samples computed during previous loops through the process; and pp is the pitch period given in samples.

Figure 10:
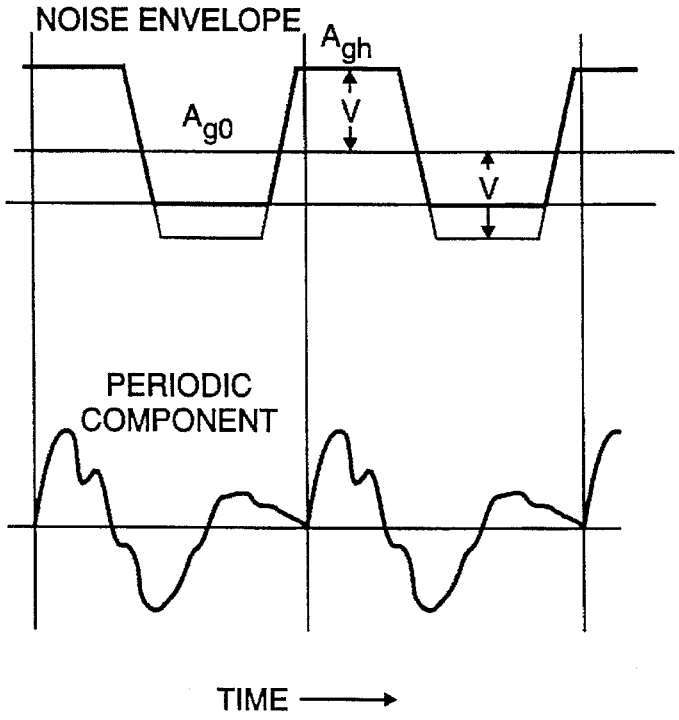
FIG. 10 illustrates a graphical representation of the envelopes of frication and aspiration computed in five sections per pitch period.

FIG. 10 illustrates a graphical representation of the envelopes of frication and aspiration computed in five sections per pitch period. The first and fifth sections have amplitudes $A_{go}$ plus VO (designated V in the top curve of FIG. 10). The third section has an amplitude $A_{go}$ minus VO, but is preferably truncated to not pass below zero. The first step is to determine the switching times from one region to the next, block 413.

```
ppj[0] = .3 * pp /* from region 1 to 2 */
ppj[1] = .4 * pp /* from region 2 to 3 */
ppj[2] = .8 * pp /* from region 3 to 4 */
ppj[3] = .9 * pp /* from region 4 to 5 */
The second step is to determine the slope in each region,
dpj [O] = 0 /* slope in region 1 */
dpj[1] = −VO/(ppj[1]−ppj[O]) /* slope in region 2 */
dpj[2] = 0 /* slope in region 3 */
dpj[3] = −dpj[1] /* slope in region 4 */
dpj[4] = 0 /* slope in region 5 */
```

Recall that aspiration is the noise created when air flow from the glottis 112 strikes the end of esophagus 105, and frication is the noise created when air flow strikes a place of constriction such as the tongue or lower lip which is pressed close to the teeth or palate. The amplitudes of aspiration and frication are determined, block 414. Preferably, the effect of glottal area, $A_{go}$, on aspiration is defined by, $$A_h = Ao + VOP_g^{2.5},$$

Note that $A_h$ may have to be scaled to particular units depending upon the particular synthesizer utilized. $P_g$ is, as previously introduced, in the transglottal pressure, and $P_g$ raised to the power of 2.5 indicates that the amplitude of voice downstream from an orifice is typically at a 2.5 power, representative of pressure across the orifice. Preferably, the effect of the constriction is defined by, $$A_n = k(y)A_cP_c^{2.5},$$

$$A_f = A_cP_c^{2.5}$$

wherein k(y) is a variable gain dependent upon the place of the constriction. Noise of the constriction at the teeth (phonemes "F" and "TH", such as in "THin") are only about a quarter as loud as constrictions behind the teeth. Again if the variable y is not articulatory, it may be defined as one of VAn[J], as previously discussed; $P_c$, previously defined, is similarly raised to the power of 2.5 to approximate known behavior of turbulence noise. Conventional processes are utilized to generate an output data set representative of the output wave form, block 415. One preferred conventional process is more fully described in "A Model of Articulatory Dynamics and Control", *Proceedings of the IEEE,* vol. 64, no. 4, pp. 452–460 (1976), by C. H. Coker, which was previously incorporated by reference.

FIG. 8 illustrates a graphical representation of $A_{gw}$ that operates to singularly control a plurality of acoustic quantities which are ultimately utilized to generate sound. The quantity $R_o$, as previously introduced, is the amplitude ratio. $R_o$ is illustrated having a high value for $A_{gw}$ in the range −20 and diminishes approximately linearly to a low value for positive $A_{gw}$. This functional response corresponds to, as previously introduced, $$R_o = (4/26)\,(4.5 - A_{gw})$$

The quantity $1/F_h$ is a high frequency roll off. $1/F_h$ is illustrated having a low value for negative $A_{gw}$ and increasing to a high value for large positive $A_{gw}$, as predicted by previously introduced equations, $$A_{ga} = .48A_{gw} + .52\sqrt{(A_{gw} + 2.3)^2 + 4A_{knee}^2} + .16;$$

$$A_{knee} = 1.25, \text{ and}$$

$$F_h = \frac{k_hF_0V}{A_{ga} + A_{gaX}}$$

The curve plotted for $1/F_h$ approximately corresponds to a linear additive correction to bandwidths of vocal tract resonance. The quantity VO is, as previously introduced, the amplitude of voicing. VO is illustrated having a non-zero value for $A_{gw}$ between −20 and +20 in accordance with previously introduced equations, $$\overline{V_{target}} = \min\left(1, \frac{\max(O, A_t - A_{g0} + k_{VH}V)}{4}\right) \cdot \min\left(1, \frac{\max(0, A_{g0} + k_{VL}V)}{4}\right) \cdot V_{typ}$$

$$V_{target} = \overline{V_{target}}\sqrt{\frac{\max(0, P_g - 2)}{4\text{mbar}}}, \text{ and}$$

$$V = V_{target} + b(V - V_{target}); \quad b = \exp\left(\frac{-d}{\tau}\right).$$

For $A_{gw}$ having a range of +20 to +35, VO will stay non-zero if it is already substantially above zero, however, if VO is at a very low value it will not rise far from zero. This feature is known as hysteresis, and is a result of a property of, $$\overline{V_{target}} = \min\left(1, \frac{\max(O, A_t - A_{g0} + k_{VH}V)}{4}\right) \cdot \min\left(1, \frac{\max(0, A_{g0} + k_{VL}V)}{4}\right) \cdot V_{typ}$$

The graphical representations of $R_o$, $1/F_h$ and VO are incorporated for illustrative purposes only and are not required, but rather are preferred with reference to the illustrated embodiment. Other consequences of $A_{gw}$ by making certain relevant assumptions, for example, if a vocal tract constriction of area comparable to the glottal area, such as 20 mm$^2$, $A_{gw}$ would operate to predict the amplitude of frication in accordance with, $$\overline{P_c} = \frac{\overline{a_g^2}}{\overline{a_g^2} + a_c^2}\,P_s;\ \overline{P_g} = P_s - \overline{P_c}, \text{ and}$$

$$A_n = k(x)\max(0, a_{gh} - 5\text{ mm}^2)P_c^{2.5}$$

Additionally, although $A_{gw}$ has been utilized in accordance with the illustrated embodiment to model and approximate the combined effects of the several muscles controlling the glottal configuration, other suitable functions, models, approximations, etc. may be utilized which operate to cause the various acoustic parameters to have a similar relationship to one another. Such suitable functions cause the acoustic parameters to depend on a common cause. Accordingly, the values $R_o$, VO, and $F_h$, etc. are not essential, as for example, the vocal cord waveform or glottal air flow were characterized geometrically, or in any other form, variables would be plotted against time for training utterances, such as, /h/-to-vowel sequences for example, which preferably assume an s-shape transition for that variable and plot the nonlinear dependencies.

Note the horizontal directional arrows, at the bottom of FIG. 8, below the graphical plotting of the dependent parameters as a function of $A_{gw}$. The directional arrows represent the range of typical values of $A_{gw}$ for different phoneme groups. The illustrated arrow tips at the end of the lines denote the end of the range for stressed variants for each phoneme group. Accordingly, the non-arrow tip end, for each phoneme group, preferably corresponds to VALP [PH,J] and the length of the line corresponds to the DELTAV [PH,J]. For example, assume PH represents vowel O; J represents $A_{gw}$, then VALP[O,$A_{gw}$] and DELTA[O,$A_{gw}$] are approximately 20 and −40, respectively.

Although the present invention and its advantages have been described in detail, it should be understood that various changes, substitutions and alterations can be made herein without departing from the spirit and scope of the invention.

I claim:

1. A processing system for generating an output data set for use in phonemic synthesis to produce patterns of transition from one speech excitation state to another, said output data set including a plurality of output data subsets, said processing system comprising:

means for receiving a textual data set, said textual data set including at least one textual data subset;

at least one memory storage device operable to store a plurality of processing system instructions; and at least one processing unit for generating said output data set by retrieving and executing at least one of said processing unit instructions from said memory storage device, said processing unit operable to:

transform said received textual data set into a phonetic data set, said phonetic data set including a plurality of phonetic data subsets wherein each of said phonetic data subsets represents a particular speech state, said transformation modelling a number of acoustic parameters affecting the excitation sources of the vocal tract by deriving said parameters as nonlinear functions of a single excitation control variable; and interpolate said phonetic data set as a function of the single excitation control variable to generate said output data set whereby said phonetic data subsets are combined to determine their collective contributions to each one of said output data subsets.

2. The processing system as set forth in claim 1 further including means for transmitting said output data set to a speech synthesizer in which nearly all excitation of the speech synthesizer is controlled by said single excitation control variable.

3. The processing system as set forth in claim 1, wherein said processing unit is further operable to calculate said physiological variable as a function of selected physical changes as said human vocal system transitions from one speech excitation state to another.

4. The processing system as set forth in claim 3 wherein said physiological variable represents human muscle behavior within said human vocal system, and said processing unit is operable to determine the changes in distance between the vocal cords of said human vocal system for a time period.

5. The processing system as set forth in claim 1, wherein each of said phonetic data subsets represents at least one acoustic feature.

6. The processing system as set forth in claim 5, wherein said acoustic features are selected from the group consisting of:

amplitude of fundamental harmonic of voiced sounds;

aggregate amplitude of higher harmonics;

roll-off of higher-frequency of voiced sounds;

amplitude and time envelope of aspiration; and amplitude and time envelope of fricative sounds; and at least two of said acoustic features are controlled by said single excitation control variable.

7. The processing system as set forth in claim 1 wherein said single excitation control variable represents the interaction of the plurality of muscles operable to provide control of the human glottis during speech, by varying in proportion to the area of the glottis as defined by the space between the vocal cords, during open-glottis, voiceless sounds, and said processing unit is further operable to derive a time course representing glottal control utilizing a low pass filter.

8. The processing system as set forth in claim 7 wherein said low pass filter models the behavior of the glottal area as the human vocal system transitions from one speech state to another, but the excitation control variable continues beyond the point where measurable glottal area goes nominally to zero.

9. A processing system comprising:

an input port for receiving a textual data set including a plurality of textual data subsets; and at least one processing unit for generating an output data set representing a sequence of speech sounds, said processing unit operable to:

calculate an excitation control variable as a function of selected physical changes of a human vocal system as said human vocal system transitions from one speech excitation state to another; and process said textual data set as a function of said excitation control variable to generate said output data set and model a number of acoustic parameters affecting the excitation sources of the vocal tract by deriving said parameters as nonlinear functions of the excitation control variable, whereby said textual data subsets are converted to a plurality of phonetic data sets which are combined together to determine their collective contributions to each one of said speech sounds.

10. The processing system as set forth in claim 9 further including means for transmitting said output data set to a speech synthesizer in which nearly all excitation of the speech synthesizer is controlled by said excitation control variable.

11. The processing system as set forth in claim 9, wherein said excitation control variable represents human muscle behavior within said human vocal system, and said processing unit is operable to estimate physical muscle changes and glottal area within said human vocal system during transitions from one speech excitation state to another, said excitation control variable varying in proportion to the glottal area during open-glottis voiceless sounds.

12. The processing system as set forth in claim 9, wherein each of said phonetic data sets represents at least one acoustic feature.

13. The processing system as set forth in claim 12, wherein said acoustic features are selected from the group consisting of:

amplitude of fundamental harmonic of voiced sounds;

aggregate amplitude of higher harmonics;

roll-off of higher-frequency of voiced sounds;

amplitude and time envelope of aspiration; and amplitude and time envelope of fricative sounds; and at least two of said acoustic features are controlled by said excitation control variable.

14. The processing system as set forth in claim 9 wherein said excitation control variable represents the interaction of the plurality of muscles operable to provide control of the human glottis during speech, and said processing unit is further operable to derive a time course representing glottal control utilizing an s-shaped filter, but the excitation control variable continues beyond the point where the measurable glottal area goes nominally to zero.

15. The processing system as set forth in claim 14 wherein said s-shaped filter models the behavior of the glottal width as the human vocal system transitions from one speech state to another.

16. A method for generating an output data set of acoustic parameters from a received textual data set, said output data set representative of patterns of transition from one speech excitation state to another, said method comprising the steps of:

converting said received textual data set to a phonetic data set, said phonetic data set including a plurality of phonetic data subsets wherein each of said phonetic data subsets represents a particular speech state:

assigning at least one phone descriptor to each of said phonemic data subsets and converting each said assigned phone descriptor to time series;

producing a speech excitation control variable representative of selected portions of a human vocal system;

generating said output data set of acoustic parameters by processing said phonetic data set with a number of acoustic parameters affecting the excitation sources of the vocal tract derived from a non-linear function of said speech excitation variable whereby the collective contributions of the phonetic data subsets are determined for each pattern of transition from one speech excitation state to another.

17. The method as set forth in claim 16 further comprising the step of transmitting said output data set to a speech synthesizer in which nearly all excitation of the speech synthesizer is controlled by said excitation variable.

18. The method as set forth in claim 16 further comprising the step of utilizing said speech excitation variable to determine changes in distance between vocal cords of said human vocal system for a time period.

19. The method as set forth in claim 16 wherein said speech excitation variable represents the interaction of the plurality of muscles operable to provide control of the human glottis during speech, and said method further comprises the step of deriving a time course representing glottal control utilizing a low pass filter.

20. The method as set forth in claim 16 wherein said generating step includes the step of calculating the amplitudes of frication and aspiration.

* * * * *